US011289842B2

(12) United States Patent
Meixner et al.

(10) Patent No.: US 11,289,842 B2
(45) Date of Patent: Mar. 29, 2022

(54) SPRING CONTACT ON A RECHARGEABLE BATTERY

(71) Applicant: Hilti Aktiengesellschaft, Schaan (DE)

(72) Inventors: Ralf Meixner, Germaringen (DE); Johannes Stempfhuber, Utting am Ammersee (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 16/606,512

(22) PCT Filed: Apr. 16, 2018

(86) PCT No.: PCT/EP2018/059656
§ 371 (c)(1),
(2) Date: Dec. 3, 2019

(87) PCT Pub. No.: WO2018/192870
PCT Pub. Date: Oct. 25, 2018

(65) Prior Publication Data

US 2020/0153142 A1 May 14, 2020

(30) Foreign Application Priority Data

Apr. 21, 2017 (EP) ..... 17167447

(51) Int. Cl.
*H01R 24/00* (2011.01)
*H01R 13/15* (2006.01)
(Continued)

(52) U.S. Cl.
CPC ..... *H01R 13/15* (2013.01); *B25F 5/02* (2013.01); *H01R 13/112* (2013.01); *H01R 24/68* (2013.01); *H01R 2103/00* (2013.01)

(58) Field of Classification Search
CPC ..... H01R 13/6275; H01R 13/6392; H01R 13/6395; H01R 13/631; H01R 13/15;
(Continued)

(56) References Cited

U.S. PATENT DOCUMENTS 3,786,392 A * 1/1974 McDaniel ..... H01R 13/652 439/103
3,890,030 A * 6/1975 McDaniel ..... G01R 19/145 439/490
(Continued)

FOREIGN PATENT DOCUMENTS

CN 1138513 A 12/1996
CN 1229377 A 9/1999
(Continued)

OTHER PUBLICATIONS

International Search Report of PCT/EP2018/059656, dated Sep. 19, 2018.

*Primary Examiner* — Thanh Tam T Le
(74) *Attorney, Agent, or Firm* — Davidson, Davidson & Kappel, LLC

(57) ABSTRACT

A power tool, which includes a receiving device having at least one receiving element and a power supply unit connectable to the power tool, for example a rechargeable battery, which includes a connecting device, the connecting device having at least one contact element, the receiving device being designed to receive and hold the connecting device, so that the at least one receiving element and the at least one contact element are connectable to each other for establishing an electrical connection. A damping element is provided on at least one contact element, whereby the at least one contact element is movable in a first direction and a second direction as well as relative to the particular receiving element, so that it is possible to counteract a relative movement between the contact element and the
(Continued)

particular receiving element when the contact element and the receiving element are connected to each other.

17 Claims, 4 Drawing Sheets

(51) Int. Cl.
*B25F 5/02* (2006.01)
*H01R 13/11* (2006.01)
*H01R 24/68* (2011.01)
*H01R 103/00* (2006.01)

(58) Field of Classification Search
CPC ..... H01R 13/112; H01R 24/68; B25F 5/001; B25F 5/02; Y02E 60/12; H02J 7/0024
USPC ..... 439/345, 373, 374, 367–369, 660; 173/213, 217; 320/112, 117
See application file for complete search history.

(56) References Cited

U.S. PATENT DOCUMENTS 3,952,239 A * 4/1976 Owings ..... B25F 3/00 320/113
3,999,110 A * 12/1976 Ramstrom ..... B23B 45/02 320/112
5,030,902 A * 7/1991 Mattinger ..... B26B 19/286 320/114
5,044,977 A * 9/1991 Vindigni ..... H01R 13/629 439/374
5,480,318 A * 1/1996 Garrison ..... H01R 13/20 439/102
5,746,617 A * 5/1998 Porter, Jr ..... H01R 13/6315 439/248
5,881,823 A 3/1999 Glauning et al.
6,065,988 A * 5/2000 Kubota ..... H01R 12/57 439/248
6,199,640 B1 3/2001 Hecht
6,304,058 B2 * 10/2001 Watson ..... H01M 2/1022 320/117
6,313,604 B1 * 11/2001 Chen ..... H01M 10/46 320/114
6,376,942 B1 * 4/2002 Burger ..... B25F 5/02 310/47
6,443,753 B1 * 9/2002 Bludis ..... H01R 13/639 439/373
6,696,817 B2 * 2/2004 Awatsu ..... H01M 2/1022 320/112
6,712,637 B2 * 3/2004 Rosa ..... H01R 13/639 439/371
6,729,413 B2 * 5/2004 Turner ..... H01M 2/1022 173/217
6,773,283 B2 * 8/2004 Yoshimatsu ..... H01R 12/714 439/180
7,243,734 B2 * 7/2007 Wu ..... H01M 2/1022 173/217
7,452,230 B1 * 11/2008 Miller ..... H01R 13/6392 439/270
7,479,760 B2 * 1/2009 Chang ..... H02J 7/0044 320/115
7,659,694 B2 * 2/2010 Griffin ..... H01R 13/6315 320/114
7,719,229 B2 * 5/2010 Kaneko ..... B60L 53/36 320/113
7,922,529 B1 * 4/2011 Meurer ..... H01R 24/50 439/578
8,113,868 B2 2/2012 Glauning et al.
8,152,554 B2 * 4/2012 Chapel ..... H01R 13/639 439/346
8,389,143 B2 * 3/2013 Roβkamp ..... H01M 2/30 429/100
8,715,018 B2 5/2014 Yoshikawa et al.
8,981,719 B2 * 3/2015 Inoue ..... H02J 7/0045 320/114
9,496,648 B1 * 11/2016 Jian ..... H01R 24/22
9,905,966 B2 2/2018 Burger et al.

FOREIGN PATENT DOCUMENTS

CN 1857873 A 11/2006
CN 103151634 A 6/2013
EP 1036636 A1 9/2000
EP 2602880 6/2013
GB 2425899 11/2006
WO WO2013/186045 A1 12/2013

* cited by examiner

SPRING CONTACT ON A RECHARGEABLE BATTERY

The present invention relates to a power tool, which includes a receiving device having at least one receiving element and a power supply unit connectable to the power tool, for example a rechargeable battery, which includes a connecting device, the connecting device having at least one contact element, the receiving device being designed to receive and hold the connecting device, so that the at least one receiving element and the at least one contact element are connectable to each other for establishing an electrical connection.

BACKGROUND OF THE INVENTION

Cordless power tools may be operated with the aid of a rechargeable battery for power supply purposes. The rechargeable battery may be removed from the power tool to be able to recharge it with electrical current in a charging device.

In an assembled state, i.e. when the power tool and the rechargeable battery are connected to each other, the transmission of the electrical current from the rechargeable battery to the power tool takes place with the aid of electrical contact partners. The contact partners are each made up of a first and a second contact element, which are connectable to each other. The first electrical contact element is situated on the rechargeable battery, and the second contact element is situated on the power tool. The second contact element is usually inserted into the first contact element. The second contact element may also be referred to as a receiving element, since it is suitable, among other things, for receiving the electrical current for the power tool.

During the operation of the power tool, a high mechanical load in the form of acceleration forces may act upon the electrical contact elements, due to application-induced vibrations or oscillations. In addition to this mechanical load, an electrical load in the form of electrical current may also take effect.

This mechanical load may result in relative movements between the contact elements on the power tool and battery sides, which cause wear on the contact elements. Depending on the application of the power tool, this wear may be additionally amplified by an introduction of dust between the contact elements. Due to the vibration-induced relative movement between the contact elements as well as due to a wear-induced increase in the contact resistance of the contact elements, a thermal overload of the contact elements may occur, which may even result in a burn-off of the contact elements.

SUMMARY OF THE INVENTION

It is an object of the present invention to provide a power tool having improved contact elements, in which a wear and, in particular the risk of a burn-off of the contact elements, is reduced.

The present invention provides a power tool, which includes a receiving device having at least one receiving element and a power supply unit connectable to the power tool, for example a rechargeable battery, which includes a connecting device, the connecting device having at least one contact element, the receiving device being designed to receive and hold the connecting device, so that the at least one receiving element and the at least one contact element are connectable to each other for establishing an electrical connection.

A damping element is provided on at least one contact element, whereby the at least one contact element is movable in a first direction and a second direction as well as relative to the particular receiving element, so that it is possible to counteract a relative movement between the contact element and the particular receiving element when the contact element and the receiving element are connected to each other.

A relative movement between the contact element and the receiving element may be reduced hereby, thus making it possible to counteract the vibration-induced wear on the contact element and the receiving element.

According to one advantageous specific embodiment of the present invention, it may be provided that the damping element is designed as a spring and is positioned behind the contact element in the first direction, so that a spring force applied by the damping element designed as a spring presses the contact element in the second direction. In particular, the maximum freedom of movement of the contact element relative to the receiving element may be effectively counteracted hereby.

According to an alternative specific embodiment, however, it is also possible for the damping element to be designed as a component including an elastically deformable material. An elastomer or any other suitable dimensionally stable yet elastically deformable plastic is possible as the material.

This makes it possible to easily counteract a vibration-induced movement of the contact element in multiple directions, i.e. not only in the direction of or against the direction of the receiving element.

BRIEF DESCRIPTION OF THE DRAWINGS

Other advantages result from the following description of the figures. The figures illustrate different exemplary embodiments of the present invention. The figures, the description and the claims contain numerous features in combination. Those skilled in the art will advantageously also consider the features individually and combine them to form other meaningful combinations.

DETAILED DESCRIPTION

Figure 1:
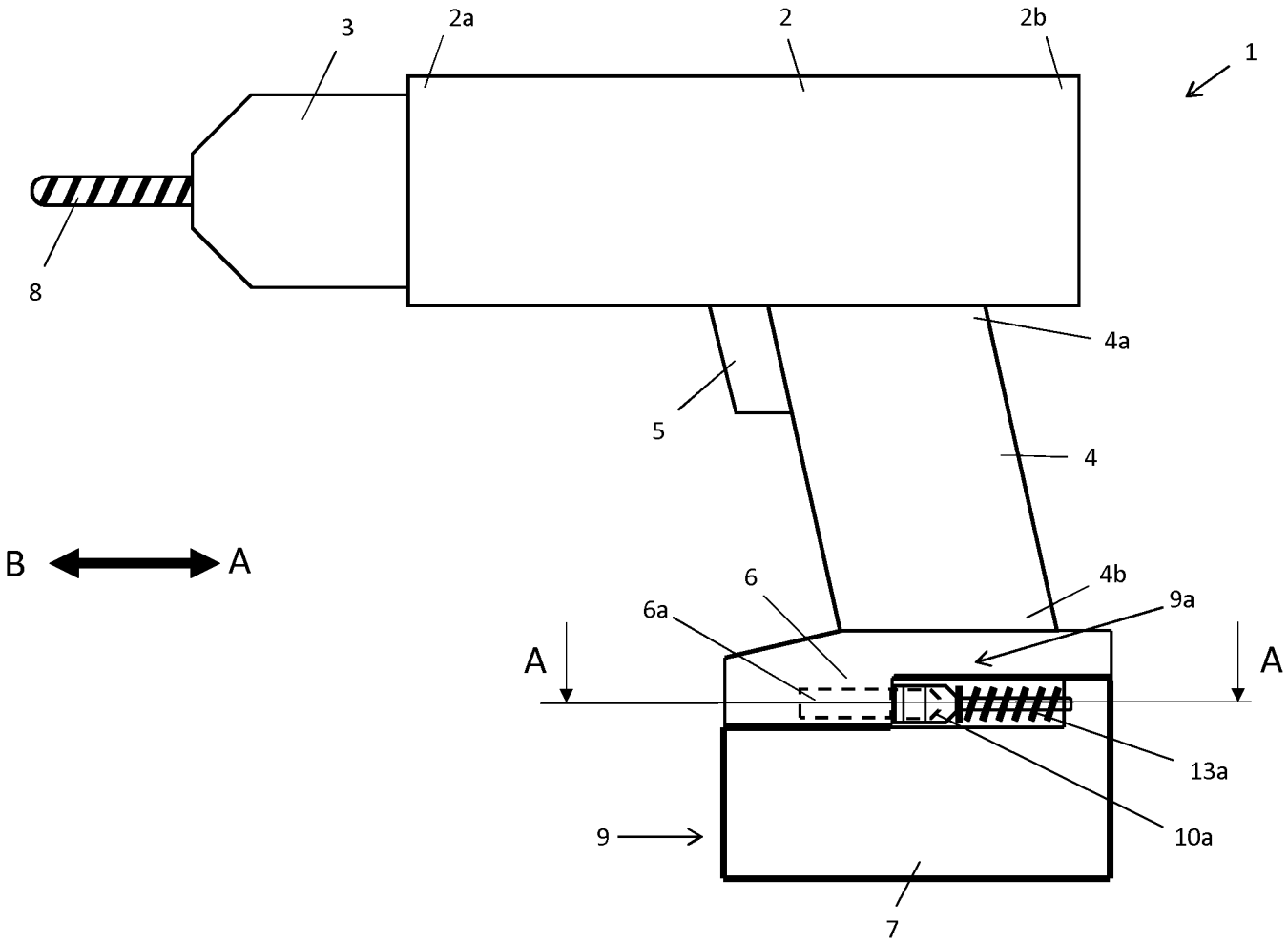
FIG. 1 shows a side view of a power tool according to the present invention, including a rechargeable battery connected to the power tool.
Figure 2:
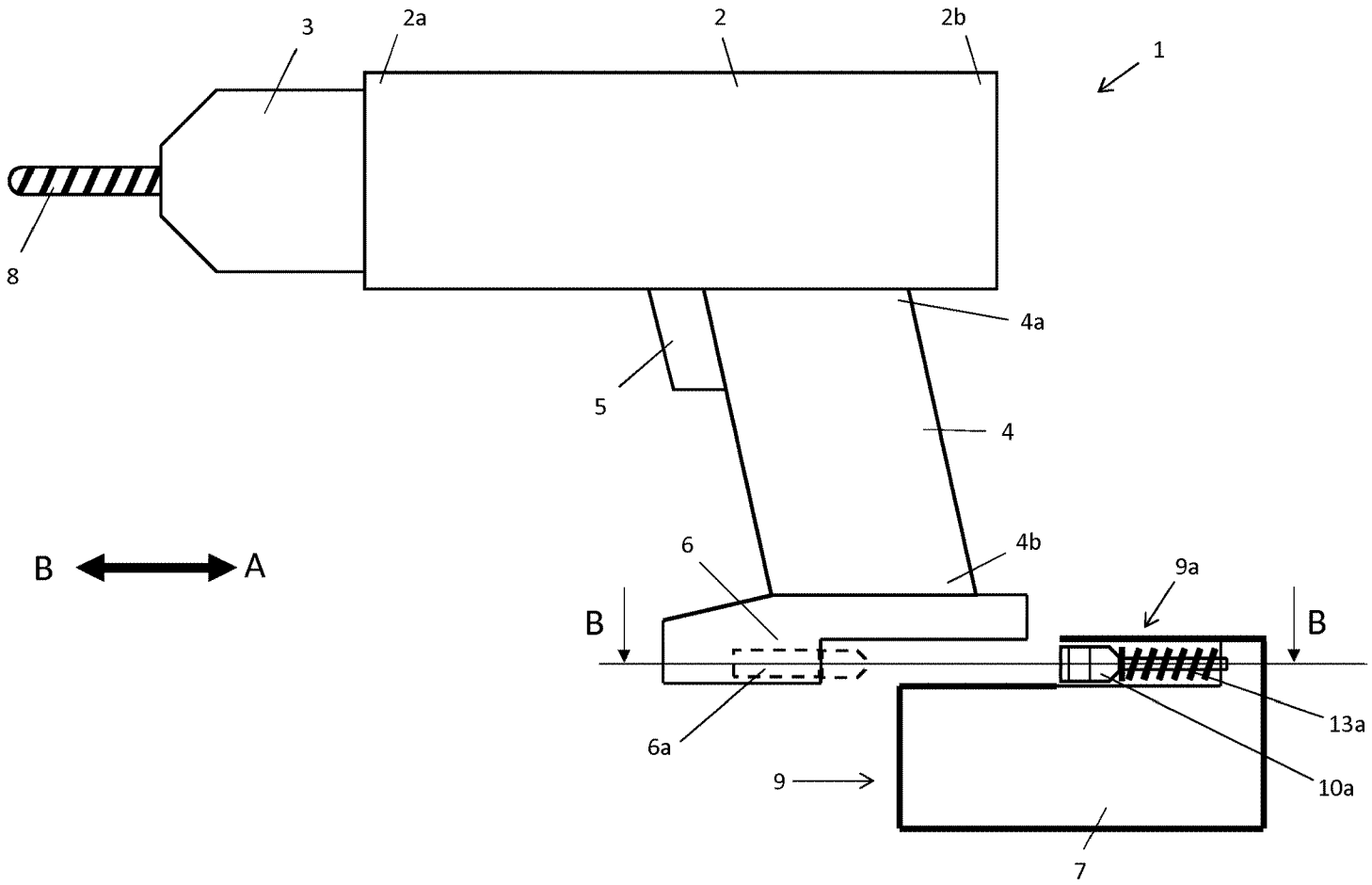
FIG. 2 shows another side view of a power tool according to the present invention, including a rechargeable battery removed from the power tool.

An example of a specific embodiment of power tool 1 according to the present invention is illustrated in FIGS. 1 and 2.

Power tool 1 is designed in the form of a power drill. However, it is also possible for power tool 1 to be a hammer drill, a circular saw or the like.

Power tool 1 illustrated in FIGS. 1 and 2 essentially includes a housing 2, a tool holder 3 and a handle 4, which has an activation switch 5. In addition, power tool 1 includes a receiving device 6 for a power supply unit 7. As illustrated in FIGS. 1 through 4, power supply unit 7 is designed as a rechargeable battery, also referred to as a battery.

According to another specific embodiment of the present invention (not illustrated in the figures), power supply unit 7 may also be designed as a connecting unit having a power cord for connection to a power network.

FIG. 1 shows a state in which power supply unit 7 designed as a battery is connected to power tool 1. For this purpose, battery 7 is pushed onto receiving device 6 in arrow direction B. As illustrated in FIG. 2, battery 7 may be removed again from receiving device 6, and thus from power tool 1, according to arrow direction A (and against arrow direction B). Power supply unit 7 is held on power tool 1 by a locking device, which is not illustrated.

Housing 2 has a first end 2*a* and a second end 2*b*. Tool holder 3 is positioned on a first end 2*a* of housing 2. Tool holder 3 is used to receive and detachably hold a tool 8. Tool 8 illustrated in FIGS. 1 and 2 is designed in the form of a drill.

Handle 4 has activation switch 5, a first end 4*a* and a second end 4*b*. Activation switch 5 is used to actuate power tool 1. First end 4*a* of handle 4 is fastened to a second end 2*b* of the housing and below housing 2.

Receiving device 6 for power supply unit 7 designed as a battery is positioned on second end 4*b* of handle 4.

Figure 3:
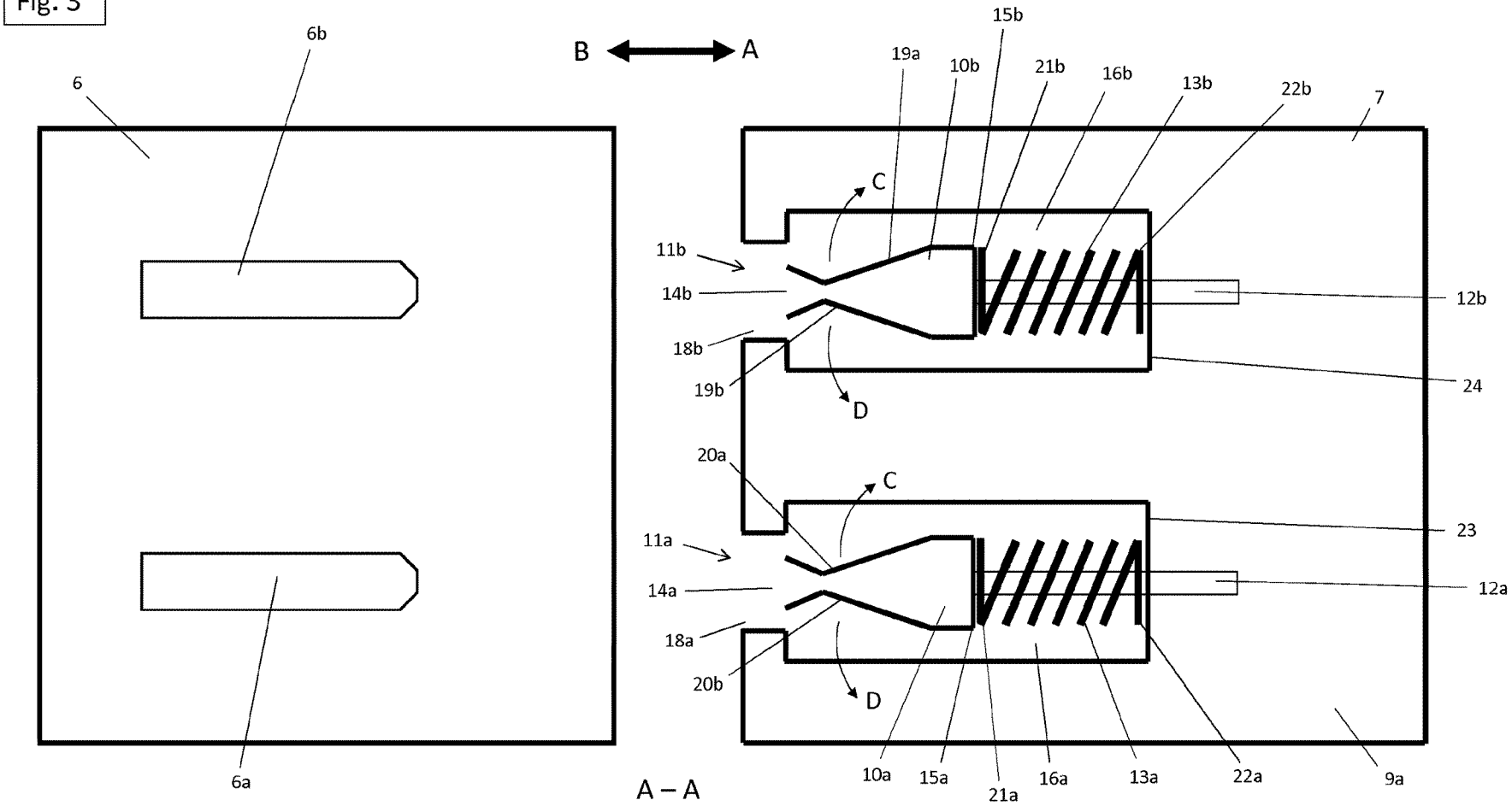
FIG. 3 shows a sectional view along section line A-A in FIG. 1, the rechargeable battery and the power tool being separated from each other.
Figure 4:
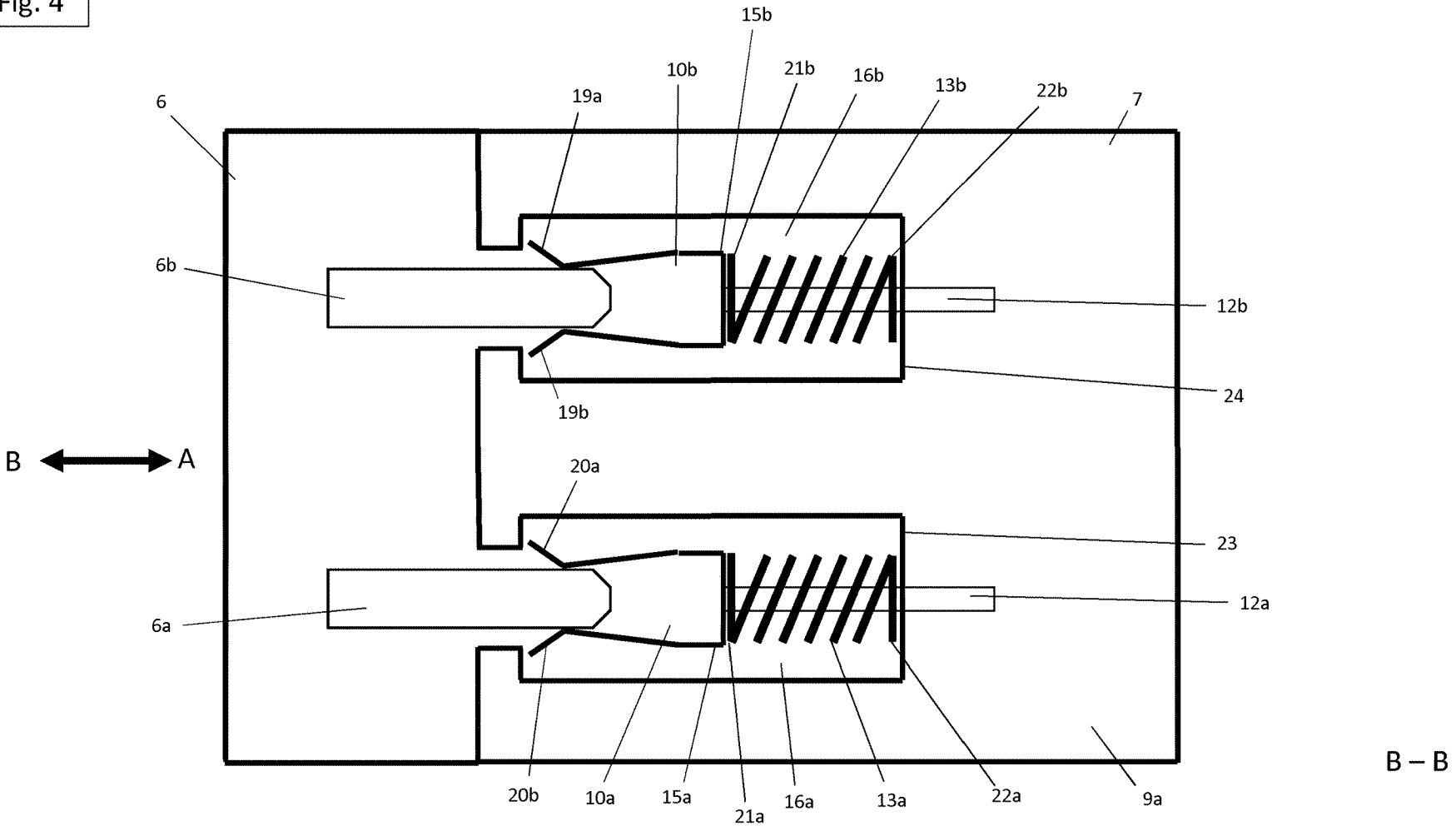
FIG. 4 shows a sectional view along section line B-B in FIG. 2, the rechargeable battery and the power tool being connected to each other.

As illustrated in FIGS. 3 and 4, receiving device 6 includes a first receiving element 6*a* and a second receiving element 6*b*. Alternatively, more than two receiving elements may be provided. It is possible that one receiving element has both a positive pole and a negative pole for supplying electrical power. Both first and second receiving elements 6*a*, 6*b* are designed in the form of a contact plate. Alternatively, first and second receiving element 6*a*, 6*b* may also be designed as a cylinder.

Power supply unit 7 designed as a battery essentially includes a housing 9, in which a number of individual, interconnected power storage cells, also referred to as battery cells, are positioned. With the aid of the battery cells, electrical energy may be stored in battery 7.

The battery cells are not illustrated in the figures.

A connecting device 9*a*, which has a first contact element 10*a* and a second contact element 10*b*, is positioned on an upper end of housing 9. Connecting device 9*a* is used for connection to receiving device 6. For this purpose, connecting device 9*a* is inserted into receiving device 6 and held thereby.

Alternatively, more than two contact elements may also be provided. It is possible that one contact element has both a positive pole and a negative pole for supplying electrical power.

First contact element 10*a* is used for detachable connection to first receiving element 6*a*, and second contact element 10*b* is used for detachable connection to second receiving element 6*b* (cf. FIGS. 3 and 4). By connecting first and second contact elements 10*a*, 10*b* to particular first and second receiving elements 6*a*, 6*b*, the electrical energy stored in the battery cells may be conducted from battery 7 to receiving device 6. The electrical energy is subsequently passed on to electrical consumers in power tool 1.

In the specific embodiment which is not illustrated, in which power supply unit 7 is not designed as a battery but as a connecting unit for a power network, the connecting unit also has a first contact element 10*a* and a second contact element 10*b* for the particular connection and establishment of an electrical connection with first and second receiving elements 6*a*, 6*b* of receiving device 6.

An electric motor for generating a torque is positioned in housing 2 of power tool 1. The electric motor is thus an electrical consumer of electrical energy. The torque generated in the electric motor is transmitted to tool holder 3 via an output shaft and a transmission. Tool 8 is rotated with the aid of the transmitted torque. The electric motor, the output shaft and the transmission are not illustrated in the figures.

As illustrated, in particular in FIGS. 3 and 4, first contact element 10*a* includes a first contact plug 11*a*, a first litz wire 12*a* and a first damping element 13*a*. Second contact element 10*b* includes a second contact plug 11*b*, a second litz wire 12*b* and a second damping element 13*b*. First contact plug 10*a* has a first end 14*a* and a second end 15*a*. Second contact plug 11*b* has a first end 14*b* and a second end 15*b*. First litz wire 12*a* is connected to second end 15*a* of first contact plug 10*a*, and second litz wire 12*b* is connected to second end 15*b* of second contact plug 10*b*. Litz wires 12*a*, 12*b* are provided with a flexible design and permit a movement of contact plugs 11*a*, 11*b* in directions A and B. Moreover, litz wires 12*a*, 12*b* are used to transmit the electrical energy from the battery cells to particular contact elements 10*a*, 10*b*.

First contact element 10*a* is furthermore situated in a first contact chamber 16*a*, and second contact element 10*b* is situated in a second contact chamber 16*b*. The two contact chambers 16*a*, 16*b* are essentially designed as bulges for particular contact elements 10*a*, 10*b* and are positioned side by side on an upper end 17 of battery housing 9. Each contact chamber 16*a*, 16*b* designed as a bulge thus has an opening 18*a*, 18*b*, through which contact plugs 11*a*, 11*b* are accessible in contact chambers 16*a*, 16*b*. The two contact plugs 11*a*, 11*b* are situated in particular contact chambers 16*a*, 16*b* in such a way that first end 14*a*, 14*b* of particular contact plug 11*a*, 11*b* faces opening 18*a*, 18*b* of contact chamber 16*a*, 16*b*.

In addition, first contact plug 11*a* includes a first contact blade 19*a* and a second contact blade 19*b*, and second contact plug 11*b* includes a first contact blade 20*a* and a second contact blade 20*b*.

As indicated in FIG. 3, contact blades 19*a*, 19*b*, 20*a*, 20*b* are provided with a movable or flexible design, so that first contact blade 19*a*, 20*a* may be reversibly or elastically pivoted in arrow direction C, and second contact blade 19*b*, 20*b* may be reversibly or elastically pivoted in arrow direction D. The movability of contact blades 19*a*, 19*b*, 20*a*, 20*b* is used to be able to receive particular receiving element 6*a*, 6*b* designed as contact plates, so that each contact plate abuts first and second contact blades 19*a*, 19*b*, 20*a*, 20*b* when battery 7 is properly connected to power tool 1 (cf. FIG. 4).

First and second damping elements 13*a*, 13*b* are designed as springs according to the present exemplary embodiment. Spring 13*a* a first end 21*a* as well as a second end 22*a*, and spring 13*b* a first end 21*b* and a second end 22*b*. Each damping element 13*a*, 13*b* designed as a spring is situated in particular contact chamber 16*a*, 16*b* and in relation to particular contact plug 11*a*, 11*b* in such a way that first end 21*a*, 21*b* of spring 13*a*, 13*b* abuts second end 15*a*, 15*b* of particular contact plug 11*a*, 11*b*. Second end 22*a*, 22*b* of each spring 13*a*, 13*b* abuts a back wall 23, 24 of each contact chamber 16*a*, 16*b*. The spring force of each spring 13*a*, 13*b* thus presses particular contact plug 11*a*, 11*b* in arrow direction A. It should be noted that the length and characteristic of particular litz wires 12*a*, 12*b* are selected in such a way that they may follow the entire spring deflection of springs 13*a*, 13*b*. In other words, litz wires 12*a*, 12*b* are at least long enough that they are not torn off by particular contact plug 11*a*, 11*b* when contact plug 11*a*, 11*b* is moved over the entire distance in direction A.

With the aid of damping elements 13*a*, 13*b* designed as springs, vibration-induced relative movements (e.g. in arrow directions A and B) may be compensated for, which occur between contact element 10*a*, 10*b* and receiving element 6*a*, 6*b* when machine tool 1 is in use.

What is claimed is:

1. A power tool comprising:

a receiving device having at least one receiving element;

a power supply unit connectable to the power tool and including a connecting device, the connecting device having at least one contact element, the receiving device being designed to receive and hold the connecting device, so that the at least one receiving element and the at least one contact element are connectable to each other to establish an electrical connections; and a damping element on the at least one contact element, the at least one contact element being movable in a first direction and a second direction as well as relative to a respective receiving element of the at least one receiving element to be able to counteract a relative movement between the contact element and the respective receiving element when the contact element and the receiving element are connected to each other.

2. The power tool as recited in claim 1 wherein the damping element is designed as a spring and is positioned behind the contact element in the first direction, so that a spring force applied by the spring presses the contact element in the second direction.

3. The power tool as recited in claim 1 wherein the damping element is designed as a component including an elastically deformable material.

4. A power drill comprising the power tool as recited in claim 1.

5. The power tool as recited in claim 1 wherein the power supply unit is a rechargeable battery.

6. The power tool as recited in claim 1 wherein the at least one contact element includes a first contact plug and a first litz wire attached to the first contact plug.

7. The power tool as recited in claim 6 wherein the first contact plug has a first open end for receiving the receiving element and a second closed end, the first litz wire attached to the second closed end.

8. The power tool as recited in claim 6 wherein the first litz wire is flexible to permit a movement of the first contact plug.

9. The power tool as recited in claim 6 wherein the first contact plug is located in a first contact chamber having a first opening, the first contact plug having a first open end facing the first opening.

10. The power tool as recited in claim 1 wherein the at least one contact element includes exactly two contact elements and the at least one receiving element includes exactly two receiving elements.

11. The power tool as recited in claim 1 wherein the at least one contact element includes a first end and a second end and two opposing contact blades between the first and second end.

12. The power tool as recited in claim 11 wherein at least one of the two opposing contact blades is flexible so as to be pivotable about the second end.

13. The power tool as recited in claim 12 wherein both of the two opposing contact blades are flexible so as to be pivotable about the second end.

14. The power tool as recited in claim 11 wherein the two opposing contact blades slope to converge towards each other from the second end to a minimum spacing distance.

15. The power tool as recited in claim 14 wherein the two opposing contact blades diverge away from each other from the minimum spacing distance to the first end.

16. The power tool as recited in claim 14 wherein at least one of the two opposing contact blades is flexible so as to be pivotable about the second end.

17. The power tool as recited in claim 16 wherein both of the two opposing contact blades are flexible so as to be pivotable about the second end.

* * * * *